US010196808B1

(12) United States Patent
Gibbs et al.

(10) Patent No.: US 10,196,808 B1
(45) Date of Patent: Feb. 5, 2019

(54) BUILDING COMPRISING PREFABRICATED COMPOSITE PANELS WITH RIGID STRUCTURAL FRAME

(71) Applicants: Garrett B. Gibbs, Orinda, CA (US); William E. Lowery, Lafayette, CA (US)

(72) Inventors: Garrett B. Gibbs, Orinda, CA (US); William E. Lowery, Lafayette, CA (US)

( * ) Notice: Subject to any disclaimer, the term of this patent is extended or adjusted under 35 U.S.C. 154(b) by 0 days.

(21) Appl. No.: 15/392,296

(22) Filed: Dec. 28, 2016

Related U.S. Application Data

(60) Provisional application No. 62/278,315, filed on Jan. 13, 2016.

(51) Int. Cl.

| | |
|---|---|
| ***E04B 1/00*** | (2006.01) |
| ***E04B 1/14*** | (2006.01) |
| ***E04B 1/24*** | (2006.01) |
| ***E04B 1/41*** | (2006.01) |
| ***E04B 5/32*** | (2006.01) |
| ***E04B 7/02*** | (2006.01) |
| ***E04C 2/20*** | (2006.01) |
| ***E04B 5/02*** | (2006.01) |
| ***E04B 1/61*** | (2006.01) |
| *E04B 1/38* | (2006.01) |

(52) U.S. Cl.
CPC ..... *E04B 1/14* (2013.01); *E04B 1/2403* (2013.01); *E04B 1/40* (2013.01); *E04B 1/61* (2013.01); *E04B 5/32* (2013.01); *E04B 7/02* (2013.01); *E04C 2/205* (2013.01); *E04C 2/50* (2013.01); *E04B 2001/2451* (2013.01); *E04B 2001/2463* (2013.01); *E04B 2001/405* (2013.01)

(58) Field of Classification Search
CPC ..... E04B 1/34321; E04B 1/1903; E04B 1/14; E04H 1/005; E02D 27/00; E02D 27/01
USPC ..... 52/79.1, 79.5, 92.1, 465, 648.1, 653.1, 52/91.3, 745.08, 745.1, 745.16
See application file for complete search history.

(56) References Cited

U.S. PATENT DOCUMENTS

| | | | | |
|---|---|---|---|---|
| 2,204,319 | A * | 6/1940 | Parsons | A63H 33/044 446/112 |
| 2,684,134 | A | 7/1954 | Ruppel | |
| 3,123,186 | A | 3/1964 | Adkinson, Jr. et al. | |
| 3,127,960 | A | 4/1964 | Smith et al. | |
| 3,308,596 | A | 3/1967 | Cooper et al. | |
| 3,392,497 | A * | 7/1968 | Cushman | E04B 1/6183 52/241 |
| 3,427,767 | A | 2/1969 | Schaefer | |

(Continued)

*Primary Examiner* — Chi Q Nguyen
(74) *Attorney, Agent, or Firm* — David Pressman

(57) ABSTRACT

A building structure (100) is erected on a concrete slab (105). The structure comprises a rigid beam-and-post frame (110) and a plurality of wall and roof panels (130, 145). A first end of the posts (120) of the frame are secured to the concrete slab. A beam (115) is secured to a second end of the posts. Adjacent wall and roof panels are secured to one-another by interlocking edges joined with adhesive or other fasteners. Wall panels adjacent to the posts of the frame may be secured to the posts. Roof panels are secured to the beam and wall panels. Wall panels are secured to the concrete slab by adhesive sealant (1000), angles (1005), and bolts (1010, 1015). Ceiling panels are secured to the beam by a plurality of bolts (1010), and brackets (1005, 1200). Openings (135) for windows and doors are formed in the wall panels.

18 Claims, 7 Drawing Sheets

(56) References Cited

U.S. PATENT DOCUMENTS 3,439,459 A 4/1969 Silberkuhl
3,564,785 A 2/1971 Kephart, Jr.
3,611,667 A 10/1971 Maxwell, Sr.
3,713,258 A 1/1973 Svensson
3,921,355 A * 11/1975 Pennecot ..... E04B 1/20 52/262
3,996,693 A * 12/1976 Walmer ..... A63H 3/52 446/105
4,365,453 A 12/1982 Lowe
4,662,519 A * 5/1987 Ciociola ..... A63H 3/52 206/1.5
5,140,913 A 8/1992 Takeichi et al.
5,619,826 A * 4/1997 Wu ..... E04H 1/1216 52/35
5,860,258 A 1/1999 Faith et al.
6,604,328 B1 8/2003 Paddock
6,862,847 B2 3/2005 Bigelow
8,166,714 B2 5/2012 Ziegelman
8,528,294 B2 9/2013 Vanker et al.
8,539,732 B2 * 9/2013 Leahy ..... E04H 1/005 52/309.9
8,677,698 B2 3/2014 Segall
8,701,356 B2 * 4/2014 Forsland ..... E04B 1/34305 4/494
8,954,296 B2 * 2/2015 Sherman ..... G01F 1/69 703/1
9,016,026 B2 4/2015 Paulson
9,062,450 B2 * 6/2015 Philibert ..... E04B 1/34321
9,200,447 B1 * 12/2015 Bargh ..... E04C 5/08
2004/0237465 A1 12/2004 Refond
2005/0247024 A1 11/2005 Bedell
2006/0230704 A1 * 10/2006 Lambreth ..... E04B 1/34 52/745.02
2007/0044411 A1 3/2007 Meredith et al.
2007/0145640 A1 * 6/2007 Jones ..... B28B 7/0017 264/299
2007/0245676 A1 * 10/2007 Jaks ..... E04B 1/34315 52/639
2009/0000211 A1 * 1/2009 Lozier ..... E04H 9/14 52/23
2010/0263299 A1 * 10/2010 Ohnishi ..... E04B 1/14 52/79.1
2012/0279141 A1 11/2012 Wiederick
2013/0074424 A1 * 3/2013 Trascher ..... E04B 1/08 52/79.5

* cited by examiner

BUILDING COMPRISING PREFABRICATED COMPOSITE PANELS WITH RIGID STRUCTURAL FRAME

CROSS-REFERENCE TO RELATED APPLICATION

This application claims priority of Provisional Patent Application Ser. No. 62/278,315, filed 1 Jan. 2016.

BACKGROUND

Prior Art

Conventional building structures are generally expensive in terms of the volume enclosed per dollar of material and erection costs. Even the simplest one-room building typically requires a great number of wood or steel posts and beams assembled to form a frame structure on which sheets of sheathing are mechanically attached to enclose the space within the building. In most cases, the assemblage requires thousands of individual pieces on site during construction and is time consuming, labor intensive, and costly. In the past, various attempts have been made to reduce these expenses.

The following is a list of some possibly relevant prior art that shows the component parts and construction of various building structures. Following this list is a discussion of these references.

| Pat. or Pub. Nr. | Kind Code | Issue or Pub. Date | Patentee or Applicant |
|---|---|---|---|
| U.S. Pat. No. 2,684,134 | B1 | 1954 Jul. 20 | Ruppel |
| U.S. Pat. No. 3,123,186 | B1 | 1964 Mar. 3 | Adkinson, Jr. et al |
| U.S. Pat. No. 3,127,960 | B1 | 1964 Apr. 7 | Smith et al. |
| U.S. Pat. No. 3,308,596 | B1 | 1967 Mar. 14 | Cooper et al. |
| U.S. Pat. No. 3,427,767 | B1 | 1969 Feb. 18 | Schaefer |
| U.S. Pat. No. 3,439,459 | B1 | 1969 Apr. 22 | Silberkuhl |
| U.S. Pat. No. 3,564,785 | B1 | 1971 Feb. 23 | Kephart, Jr. |
| U.S. Pat. No. 3,611,667 | B1 | 1971 Oct. 12 | Maxwell, Sr. |
| U.S. Pat. No. 3,713,258 | B1 | 1973 Jan. 30 | Svensson |
| U.S. Pat. No. 4,365,453 | B1 | 1982 Dec. 28 | Lowe |
| U.S. Pat. No. 5,140,913 | B1 | 1992 Aug. 25 | Takeichi et al. |
| U.S. Pat. No. 5,860,258 | B1 | 1999 Jan. 19 | Faith et al. |
| U.S. Pat. No. 6,604,328 | B1 | 2003 Aug. 12 | Paddock |
| U.S. Pat. No. 6,862,847 | B2 | 2005 Mar. 8 | Bigelow |
| U.S. Pat. No. 8,166,714 | B2 | 2012 May 1 | Ziegelman |
| U.S. Pat. No. 8,677,698 | B2 | 2014 Mar. 25 | Segall |
| U.S. Pat. No. 9,016,026 | B2 | 2015 Apr. 28 | Paulson |
| U.S. Pat. No. 8,528,294 | B1 | 2010 Jun. 29 | Yanksic |
| US 2004/0237465 | A1 | 2004 Dec. 2 | Refond |
| US 2005/0247024 | A1 | 2005 Nov. 10 | Bedell |
| US 2007/0044411 | A1 | 2007 Mar. 1 | Meredith et al. |
| US 2012/0279141 | A1 | 2012 Nov. 8 | Wiederick |

Ruppel shows a roof diaphragm comprising a plurality of metallic deck elements that are secured by a plurality of weldments to supporting trusses. The diaphragm is supported by a plurality of wall panel units that are secured together at their edges to form the four sides of a building. The lower cords of the trusses are attached to wall panels to form a rigid structure.

Adkinson shows wall construction for a shelter. His wall comprises a sandwich of aluminum skins that are separated by a semi-rigid plastic foam. A plurality of spaced, vertically-oriented, modified I-beams with inner and outer transverse flanges are partially embedded in the wall and extend inwardly therefrom, i.e. into the shelter. The outer transverse flange is embedded in the foam that separates the inner and outer skins and the inner transverse flange is in contact with the inner skin.

Smith shows a modular panel system for constructing a building. A plurality of flanged, coplanar, sheet metal sections with incorporated stiffening lengths are joined by nuts and bolts to form a building structure.

Cooper shows a building constructed from a plurality of corrugated panels. His building comprises sheet metal walls and roofing that are configured and formed to eliminate or reduce the need for conventional internal supports such as frames, purlins and girts.

Silberkuhl shows a building construction element comprising a rectangular panel of rigid, pleated material. The pleats form a 3-sided pyramid in the panel. Each panel may further include a tubular reinforcing rib. A plurality of these panels are secured together to form walls and roof of a building structure.

Kephart shows a building structure comprising a plurality of sheet material panels. The sheets are scored to form flanges along their edges and the flanges are interconnected to form a folded structure for easy delivery and assembly at a work site.

Maxwell shows a method for erecting a building made of a plurality of standardized panels. The building includes a beam, "T" (FIG. 1), that supports a roof. The beam is mounted on the upper end of wall units at each end of the building.

Lowe shows a frameless metal building comprising a plurality of rectangular sheet metal roof and wall panels that have inner and outer skins. A fabricated sheet metal ridge beam rigidly connects the inner skins of the roof panels, forming a compression joint, and connects the outer skins of the roof panels to form a tension joint. The roof rests on the walls of the building, without the requirement for a frame to support the roof.

Takeichi shows a railway car body structure comprising an assembly of a plurality of panels. The panels consist of a sandwich of inner and outer sheets that are spaced apart by a cellular metal core. The panels are joined side-by-side. End sheet members at the ends of the car provide support for the wall-and-roof panels.

Faith shows a circular, modular building comprising pie-shaped modular elements. The elements are radially attached around a center column that is anchored in a column footing.

Paddock shows a portable cabin comprising wall panels, studs, floor panels, floor support members, roof panels and roof rafters that are secured together by truss members. The roof rafters are supported by wall studs.

Bigelow shows a portable building comprising a plurality of interconnected walls, a floor on which the walls are positioned, and a roof structure that rests on a roof truss. At least one of the walls, floor, or roof further includes a layer of sprayed-on urethane material and a layer of force resistant material.

Ziegelman shows buildings formed of a plurality of prefabricated modules. The modules each have a plurality of rigid frames.

Segall shows a relocatable habitat unit comprising a plurality of flat panels that include male and female connectors located on their respective peripheries. After a floor is established, the panels are placed one-at-a-time on the floor and then serially connected to one-another until the building unit is complete.

Paulson shows a method and system for forming frameless buildings using a plurality of corrugated panels.

Meredith shows a panel structure comprising a plurality of panels, each having multiple cams and cam receptacles. The panels are attached to one-another in interlocking fashion to form a building structure.

Each building structure described in the above references appears to be workable. Some have multiple frames to ensure structural integrity while others have no frame and depend on interlocking panels for strength. However they are either relatively expensive to erect, difficult to erect, and/or slow to erect.

SUMMARY

We have discovered a concept that reduces the cost, difficulty, and speed of erecting buildings, yet is strong enough to withstand any environmental stresses that may be present. Our building design combines a single, rigid beam-and-post frame unit with wall and roof panels. The beam-and-post frame unit is of an inverted U-shape made of I-beams or other linear structural members that are secured together. The posts of the unit are firmly secured to a concrete foundation slab footing at the start of construction. After the beam-and-post frame unit is installed, it provides the only supporting framework that is required for completion of the building using standard, modular, rectangular panels. A building is constructed with a small amount of relatively unskilled labor.

[DRAWING FIGURES] BRIEF DESCRIPTION OF THE DRAWINGS

REFERENCE NUMERALS

| | | | |
|---|---|---|---|
| 100 | Building structure | 105 | Concrete slab floor |
| 110 | Beam-and-post frame unit | 115 | Beam |
| 120 | Post | 125 | Wall |
| 130 | Panel | 135 | Opening |
| 140 | Roof | 145 | Roof panel |
| 300 | Plate | 305 | Welds |
| 310 | Bolt | 400 | Plate |
| 405 | Welds | 415 | Bolt |
| 600 | Core of panel | 605 | Outer layer |
| 610 | Outer edge | 615 | Outer edge |
| 700 | Corner | 705 | Adhesive sealant |
| 710 | Angle bracket | 715 | Angle bracket |
| 720 | Fastener | 800 | Foam structure |
| 805 | Skins | 810 | Ribs |
| 1000 | Adhesive sealant | 1005 | Angle |
| 1010 | Screws | 1200 | Bracket |
| 1300 | Support | 1305 | Bolt |
| 1310 | Plate | 1315 | Bolt |
| 1400 | Interior panel | | |

Detailed Description of the Drawings—First Embodiment—Panel-Enclosed Structure with Single Frame Element—FIGS. 1-16 [16]

Figure 1:
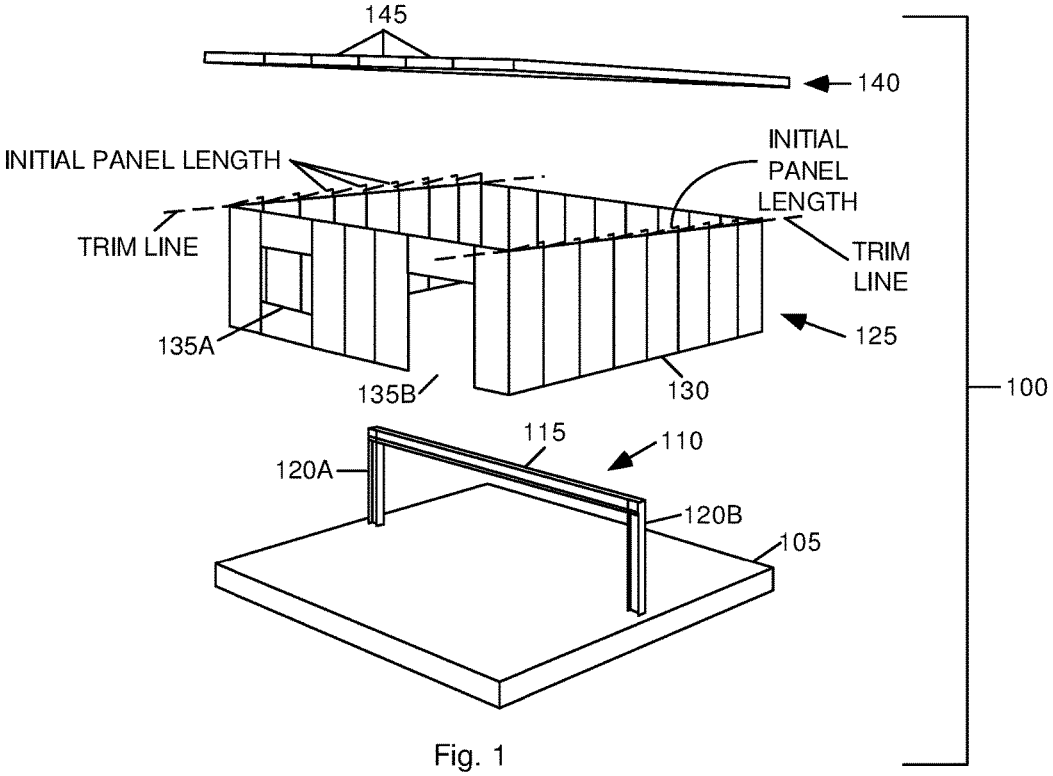
FIG. 1 is an exploded perspective view of a building structure according to one aspect of a first embodiment.
Figure 2:
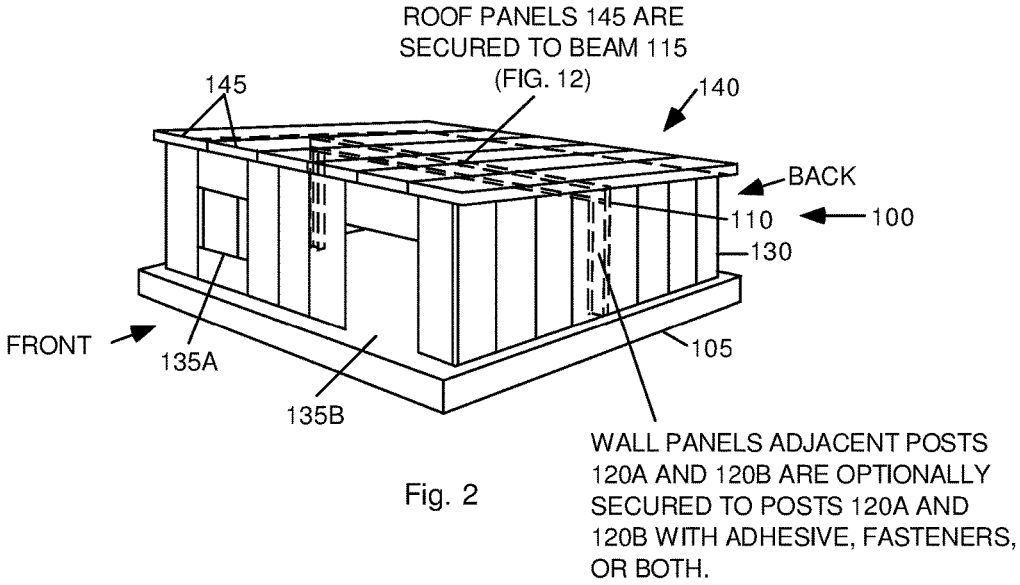
FIG. 2 is a perspective view of the structure of FIG. 1 after assembly.

Description and Overview—FIGS. 1 and 2

FIG. 1 shows a perspective, exploded view of the three principal building components, according to one aspect of a first embodiment. A building 100 comprises a concrete slab floor 105 that defines at least a perimeter of a building, a beam-and-post frame unit 110 that has an inverted U-shape and includes a beam 115 that is secured to at least two posts 120A and 120B, walls 125 comprising a plurality of panels 130 and openings such as windows and doorways 135, and a roof 140. Concrete slab foundations such as slab 105 are well-known to those skilled in the art of building construction. Assume that a suitable location has been chosen for building 100 and that slab 105 has been poured and is ready for use. Slab 105 is generally at least 10 cm larger on all sides than the outline of building 100.

FIG. 2 shows a perspective view of an assembled building 100 having an interior space. Beam and post frame unit 110 has been secured to slab 105. Panels 130 have been erected and secured to one-another and to slab 105. Roof 140 has been laid in place and secured to panels 130 and frame unit 110. Openings such as a window 135A and a door 135B comprise partial panels 130 and are arranged to accept door and window frame inserts as required. As shown, the opposite vertical sides of beam 115 are vertically oriented, face in opposite horizontal directions, and are spaced from the opposite ends of the roof, respectively.

Posts 120A and 120B are 2.5 m long with "I" dimensions 12 cm×12 cm in height and width. Beam 115 is 8 m long, with "I" dimensions 12 cm×12 cm in height and width. These dimensions are exemplary. Other sizes can be used.

Assembly—FIGS. 3 Through 12—Beam and Post Frame Unit

Figure 3:
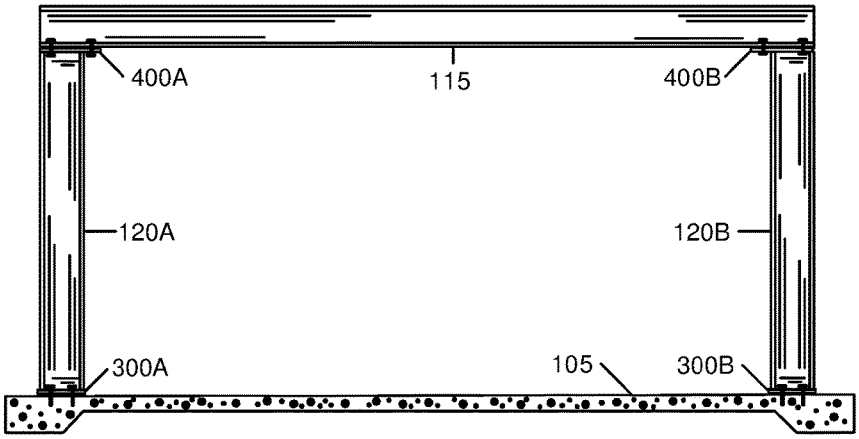
FIG. 3 shows an elevation view of a post-and-beam frame unit according to one aspect of an embodiment.

FIG. 3 shows an elevation view of beam-and-post frame unit 110 secured to slab 105.

Figure 4:
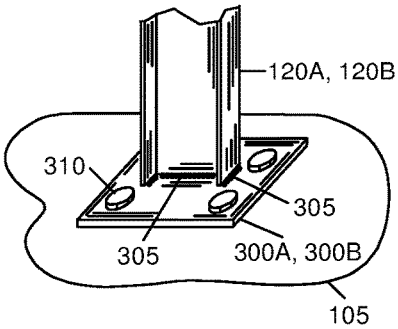
FIG. 4 shows how the posts shown in FIG. 3 are secured to a concrete slab.

FIG. 4 is a perspective detail view showing one way in which post 120A is attached to slab 105. A plate 300A, larger than post 120A is secured to a post 120A by welds 305. Plate 300A is secured to slab 105 by at least one bolt 310, such as a well-known anchor bolt for use in concrete. Post 120B is secured to slab 105 in a similar manner.

Figure 5:
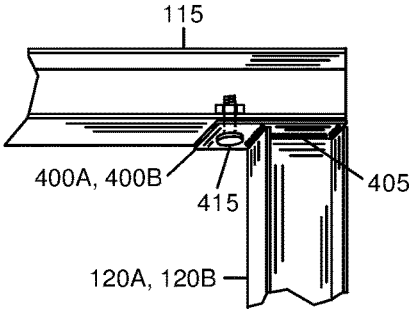
FIG. 5 shows how the beam and posts of FIG. 3 are secured to one-another.

FIG. 5 is a perspective detail view showing one way that post 120B is joined to beam 115. A plate 400B is secured to post 120B by welds 405 and beam 115 is secured to the same plate 400B by one or more bolts 415. Post 120A is joined to beam 115 in a similar manner. Joining and securing I-beams and other structural members as shown in FIGS. 4 and 5 is well-known to those skilled in the art of building construction.

Wall and Roof Panels—Wall Panels

Figure 6:
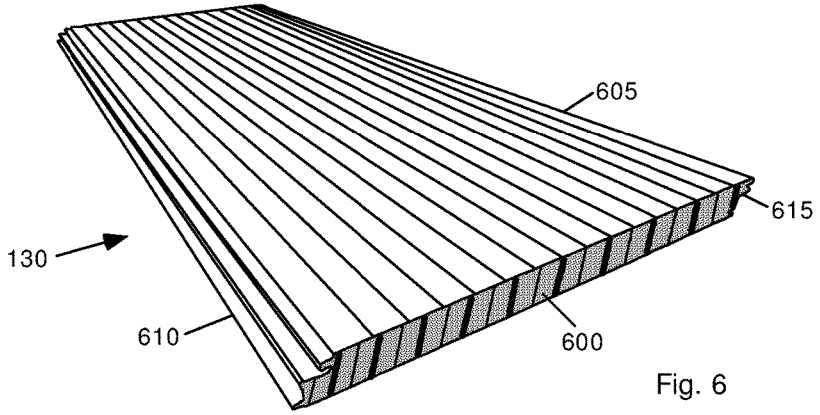
FIG. 6 is a perspective view of a wall panel used in the building structure shown in FIGS. 1 and 2.

FIG. 6 is a perspective view of one type of wall panel 130 used in this building system. Panel 130 comprises a core 600 of a rigid, thermally insulating material such as polyisocyanurate foam that is encased in a steel outer layer 605. Outer edges 610 and 615 of panel 130 have complimentary sinuous, interlocking shapes. Edge 615 of a first panel slidably mates with edge 610 of a second panel.

Figure 7A:
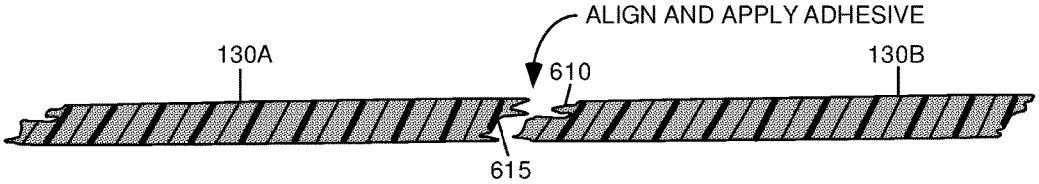
FIG. 7A is a cross-sectional end view of two wall panels like that in FIG. 6, prior to their joining.
Figure 7B:
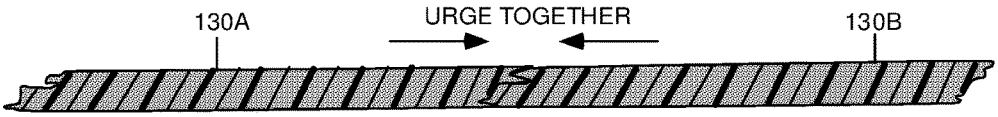
FIG. 7B is a cross-sectional end view of the two wall panels in FIG. 7 after the two panels are secured together.

FIGS. 7A and 7B show how two panels 130 that lie in the same plane are joined. A first panel 130A is first aligned with a second panel 130B. Edge 615 on panel 130A is adjacent edge 610 on panel 130B. The sinuous, interlocking edges 610 and 615 are complementary so that they become interdigitated when the panels are joined. An adhesive (not shown in this view) is applied to one or both of edges 610 and 615 and then panels 130A and 130B are forcibly urged together so that edges 610 and 615 fully mate. After the adhesive cures, the joint is permanent.

Figure 7C:
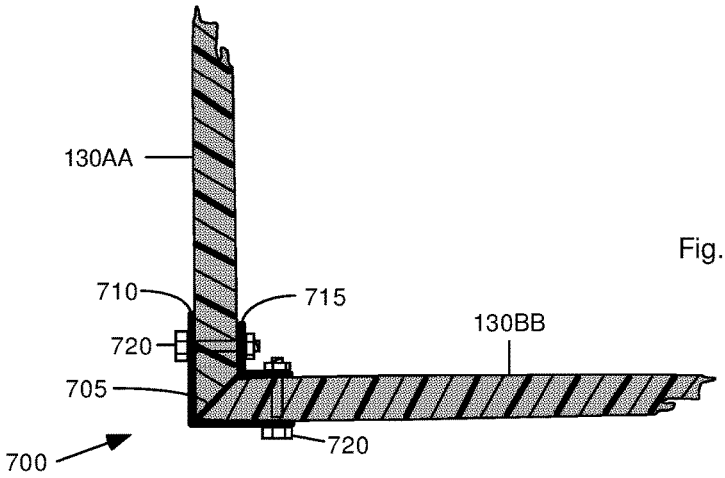
FIG. 7C is a cross-sectional view of a corner joint between two wall panels.

FIG. 7C shows how two panels 130 are joined to form a corner 700 of building 100. Two wall panels 130AA and 130BB are each mitered at 45 degrees. An adhesive sealant 705 is applied to the mitered corners and then panels 130AA and 130BB are urged together at a right angle as shown with their ends adjacent one-another. A pair of angle brackets 710 and 715 are urged into contact with the outside and inside surfaces of panels 130AA and 130BB and secured there by a plurality of fasteners 720 such as bolts, screws, or rivets. Angle brackets 710 and 715 lie substantially along the entire length of panels 130AA and 130BB. Brackets 710 and 715 are sized with respect to the thickness of panels 130AA and 130BB, as shown, and are made of metal, plastic, wood, or another sturdy construction material.

Panels 130 are 1 meter wide, 3 meters long, and 10 cm thick, although other sizes and shapes are possible. Instead of steel, another metal such as aluminum can be used. Instead of polyisocyanurate, another rigid, insulating material, such as a glass-epoxy composite, can be used. Panels 130 are manufactured by All Weather Insulated Panels, of Little Rock, Ark., U.S.A., and others. A suitable adhesive for securing the panels is a waterproof silicon-based glue or sealant, such as the non-skinning premium-grade butyl sealant sold under the trademark XtraBond 1500NS by Premier Building Solutions of Phoenix, Ariz.

Roof Panels

Figure 8:
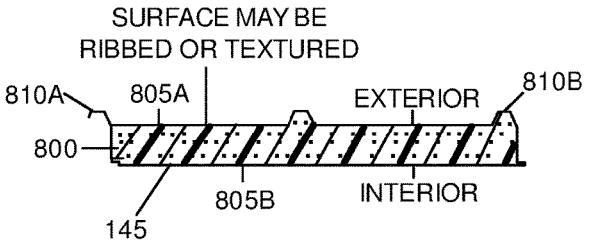
FIG. 8 is a cross-sectional end view of a roof panel such as used in FIGS. 1 and 2.

FIG. 8 shows a cross-sectional view of a roof panel 145. The length and width of panel 145 are similar to those of wall panels 130. A rigid interior foam structure 800 is clad with exterior and interior skins 805A and 805B, respectively. The construction of roof panel 145 is similar to wall panel 130, except its outer cladding is contains ribs 810A and 810B. Rib 810A is an empty extension of panel 145, i.e., there is no foam structure beneath it as there is beneath rib 810B.

Figure 9A:
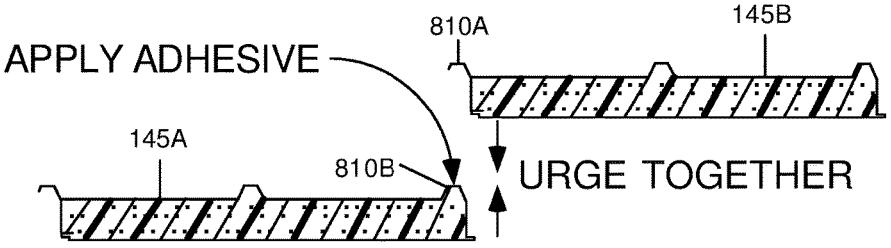
FIG. 9A is an end view of two roof panels like that in FIG. 9, prior to their joining.
Figure 9B:
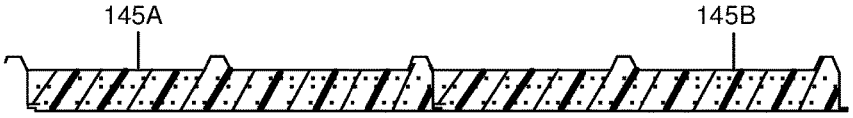
FIG. 9B is an end view of the two roof panels in FIG. 9A after they are secured together.

FIGS. 9A and 9B show how roof panels 145 are joined. In FIG. 9A, an adhesive (not shown in this view) is applied to rib 810B of a first panel 145A. Next, an adjacent panel 145B is aligned with panel 145A so that rib 810A of panel 145B is located above rib 810B of panel 145A over the full length of both panels. FIG. 9B shows panels 145A and 145B being urged together until the two panels are contiguous. This process continues until all roof panels for a building are joined.

The edges of adjacent wall or roof panels can be further secured to one-another by fasteners such as screws, bolts, brazing, or welds if desired.

Erecting Building

To erect the building a series of 4 chalk lines (not shown) are laid out on concrete slab 105 and used to mark the perimeter of the exterior walls of building 100. The chalk lines that identify the sides of the building fall adjacent the exterior-facing sides of posts 120A and 120B so that wall panels 130 adjacent the posts will be in contact with them and can be secured to them.

Exterior Walls

Building erection begins where two of walls 125 meet at one corner of building 100. A corner joint 700 (FIG. 7C) is formed between two panels 130AA and 130BB. Foam core 600 (FIG. 6) at the bottom of the two panels is coated with a sealant (not shown) that will adhesively seal and join the bottom end of both panels 130AA and 130BB to concrete slab 105. A first corner joint 700 is positioned at a predetermined corner so that panels 130AA and 130BB are oriented to extend along two walls of building 100. Corner joint 700 is then urged against concrete slab 105 and rests there.

Next, a wall panel 130A or 130B (FIGS. 7A and 7B) is prepared with sealant applied to foam core 600 at its bottom surface. Adhesive is then also applied to a vertical edge of this panel where it will meet the previously-seated first panel 130AA or 130BB. The second panel is then aligned with the chalk line mark for the adjacent back wall 125 and the edges of first and second panels 130 are joined. The remaining panels are added seriatim until the building space is enclosed with wall panels. Shortened panels for openings 135A and 135B in building 100 are installed in the same way, i.e. by gluing them to neighboring wall panels 130.

Building 100 (best seen in FIG. 2) has a flat or planar, sloped roof. Panels 130 that form the back wall of building 100 are all of the same length. Panels 130 that form the front wall of building 100 are also of the same length, but slightly longer than panels 130 that form the back wall of building 100. Panels 130 that form the side walls of building 100 increase in length from back to front and are trimmed to the proper length and angle after they are secured to slab 105 and each other. A trim line is determined by applying a chalk line mark on the exteriors of the side walls. The trim line is drawn from the top of panels 130 at the back of building 100 to the top of panels 130 at the front of building 100 and provides guidance for trimming. Trimming is done with a saw suitable for cutting panels 130, such as a high-speed rotary saw or reciprocating saw with a fine blade.

Side wall panels 130 that lie adjacent posts 120A and 120B are optionally secured to these posts. This is done by applying adhesive to the exterior side of posts 120A and 120B as these side wall panels 130 are seated on slab 105 during erection of side walls 125. The joint between panels 130 and posts 120 is optionally strengthened by the addition of angle brackets similar to those described below in connection with securing walls 125 to slab 105 and roof 140 to walls 125.

Openings such as 135A, 135B, and 135C are spanned with partial wall panels 130. Doors and windows (not shown) are included in this way and are framed separately upon completion of the erection of building 100.

Roof

After the installation and trimming of walls 125, an adhesive sealant (not shown) is applied to the upper surfaces of wall panels 130 in preparation for adding roof panels 145 to building 100. Adhesive sealant is also optionally applied to the top surface of beam 115. Next, a first roof panel 145 is laid across the open space between front and back walls 125. The height of beam-and-post unit 110 was previously determined to lie at the top of the wall panel 130 adjacent post 120A (120B) so that roof panel 145 is supported at mid-span by beam 115. Succeeding roof panels 145 are added across the top of building 100 and joined and sealed adjacent one-another as described above in connection with FIGS. 9A and 9B. Roof panels 145 can properly sized before installation or trimmed after installation, as described above in connection with the trimming of wall panels 130.

Figure 10A:
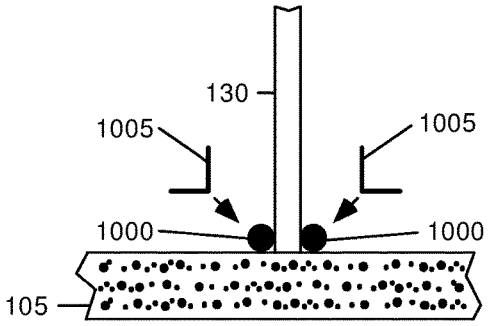
FIG. 10A is a side view showing a wall panel prior to securing of the panel to a concrete slab.
Figure 10B:
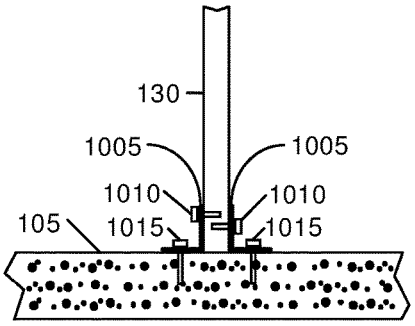
FIG. 10B is a side view of the panel of FIG. 10A after the panel is secured to a concrete slab.

Securing Walls and Roof—Walls—FIGS. 10A and 10B

FIGS. 10A and 10B are cross-sectional views showing an aspect of securing all wall panels 130 to slab 105. Wall panels 130 have been previously seated on slab 105, as described above. Beads of adhesive sealant 1000 are first applied along the interior and exterior sides of the joint between panels 130 and slab 105. Angle brackets 1005, such as extruded angle, are then firmly urged into the joints between panels 130 and slab 105, as indicated by the arrows in FIG. 10A.

FIG. 10B shows brackets 1005 in place, secured by a plurality of screws 1010 and anchor bolts 1015. Excess adhesive sealant 1000 (FIG. 10A) that has extruded during the placement of brackets 1005 has been neatly trimmed and removed (FIG. 10B). Brackets 1005 are metal, but can also be a sturdy plastic or other suitable material. They are 5 mm thick and 10 cm on each side, but can be other sizes.

Figure 11:
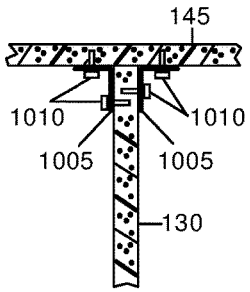
FIG. 11 is a side, cross-sectional view showing attachment of a roof panel to a wall panel.
Figure 12:
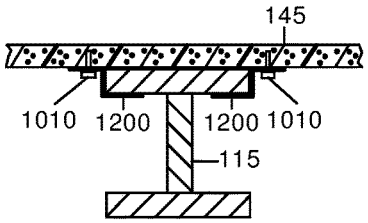
FIG. 12 is a side, cross-sectional view showing attachment of a roof panel to a beam.

Roof—FIGS. 11 and 12

FIG. 11 is a cross-sectional view showing one way that all roof panels 145 can be secured to wall panels 130. As described above with regard to securing wall panels 130 to slab 105, adhesive sealant (not shown in this view) is first applied along the joint between wall panels 130 and roof panels 140, then angles 1005 are urged into place in the joint and secured there with a plurality of screws 1010. Angles 1005 in FIG. 11 can be the same as those in FIGS. 10A and 10B, or different.

FIG. 12 is a cross-sectional view showing one way that roof panels 145 can be secured to beam 115 (FIG. 1). A pair of "Z"-shaped brackets 1200 are secured to roof panel 145 by screws 1010. Brackets 1200 extend downward from panel 145 and beneath the top portion of beam 115, as shown. A single bracket extends along the entire the length of beam 115 on either side. Alternatively, a plurality of shorter brackets 1200 that are spaced at predetermined intervals can be used. Instead of or in addition to brackets 1200, fasteners such as bolts, and adhesives are used to secure roof panels 145 to beam 115.

Brackets 1010 (FIG. 11) and 1200 (FIG. 12) prevent roof panels 145 from lifting away from building 100 when pressure differences exist between the inside and outside of building 100, such as when wind blows or when a door is suddenly opened or closed.

Figure 18:
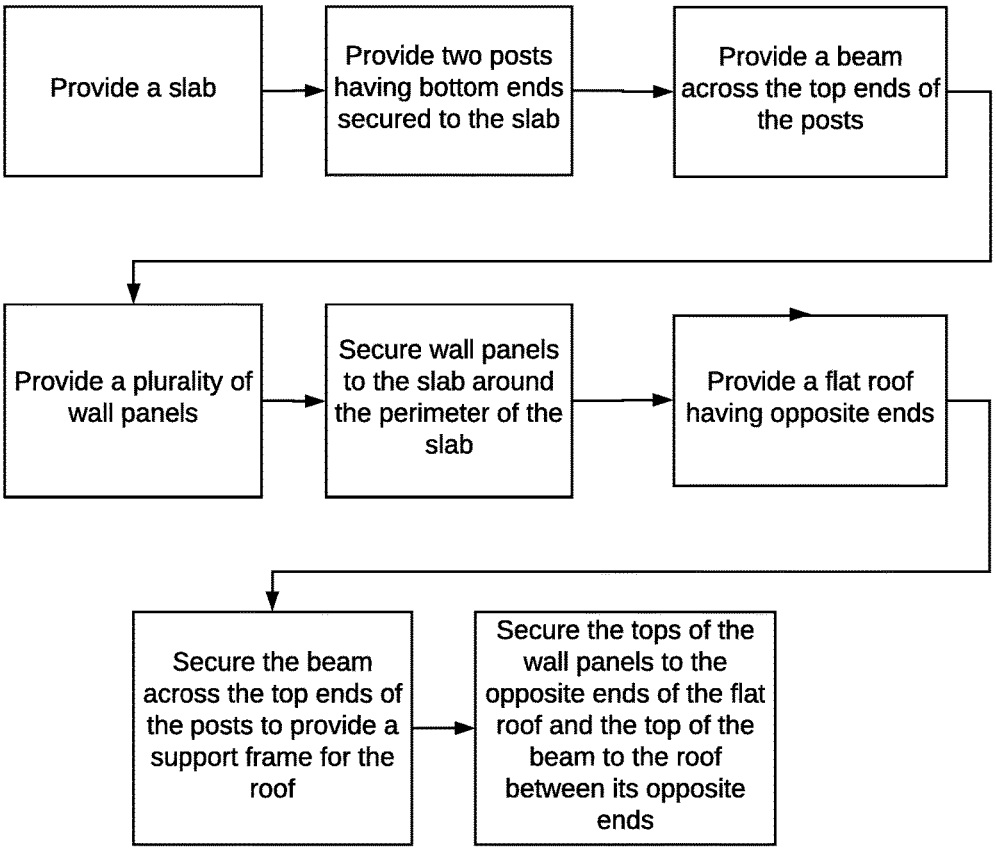
FIG. 18 shows a flow chart which illustrates the described method of constructing a building.

The flow chart of FIG. 18 illustrates the above described method of constructing building 100.

Selected Variations—FIGS. 13 Through 17

Many variations of our building concept are possible within in the present disclosure. They include different roof shapes, different post-and-beam designs, additional posts and beams, window frames, and the like.

Beam and Post Frame Unit—Additional Supports

Figure 13:
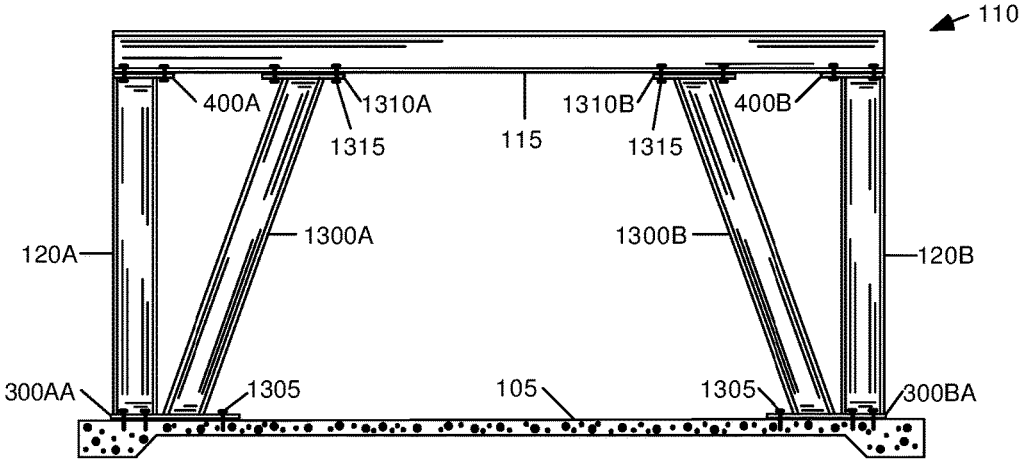
FIG. 13 is an elevation side view of a beam-and-post assembly with added strengthening members comprising beams.

FIG. 13 shows a modification of beam-and-post frame unit 110 (FIG. 3). An angled pair of supports 1300A and 1300B are added for extra strength. Supports 1300A and 1300B are optionally made of the same I-beam material as posts 120 (A, B) and beam 115. Alternately, they are another shape such as tubular, rectangular, or the like and are made of another material such as reinforced plastic or wood.

In this example, plates 300A and 300B (FIG. 3) have been lengthened and are shown as plates 300AA and 300BA. Anchor bolts 1305 secure the inner ends of plates 300AA and 300BA to slab 105. The lower end of supports of supports 1300A and 1300B are welded or otherwise firmly secured to plates 300AA and 300BA, respectively. The upper ends of supports 1300A and 1300B are secured to plates 1310A and 1310B, also by welds or brackets. In turn, plates 1310A and 1310B are secured to beam 115 by a plurality of bolts 1315.

Brackets can be used instead of welds and the attachment of supports 1300A and 1300B to plates 300A and 300B can be done on-site or previously, off-site.

This arrangement is suitable for use when wind or earth movements are present, or for large buildings that require extra strength.

Figure 14:
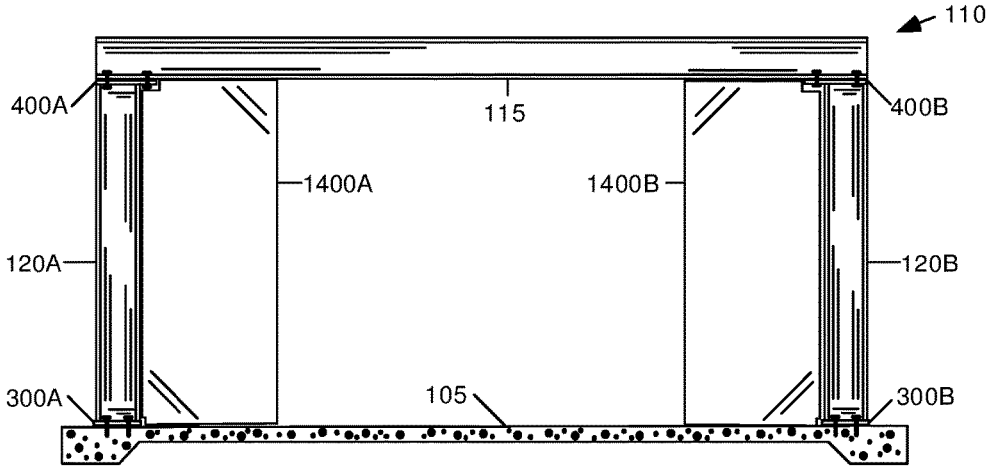
FIG. 14 is an elevation side view of a beam-and-post assembly with added strengthening and room-dividing members comprising panels.

Interior Panels FIG. 14 shows interior panels 1400A and 1400B that are used to divide the interior space of building 100 or to provide additional strength in beam-and-post frame unit 110. Panels 1400A and 1400B are secured to beam 115, posts 120A and 120B, and slab 105 by the means shown above in FIGS. 10B and 12. Panels 1400A and 1400B are optionally the same as wall panels 130 or another type of panel such as wood, metal, or plastic.

Roof Styles

Figure 15:
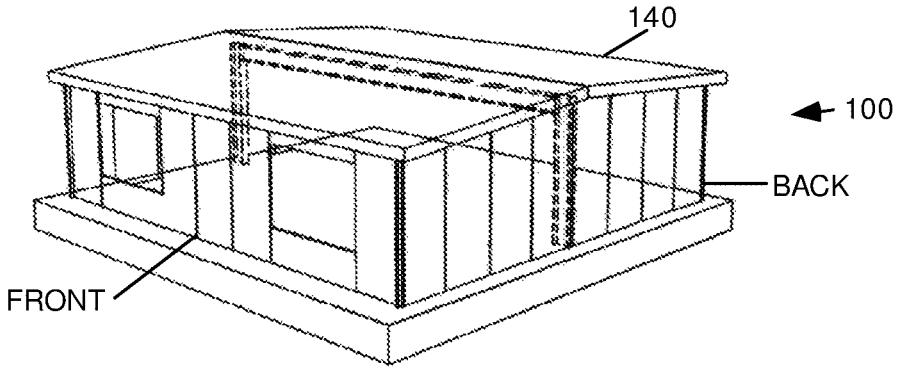
FIG. 15 is a perspective view of a building structure with a roof comprising a plurality of planes that slope downward from the center of the structure.
Figure 16:
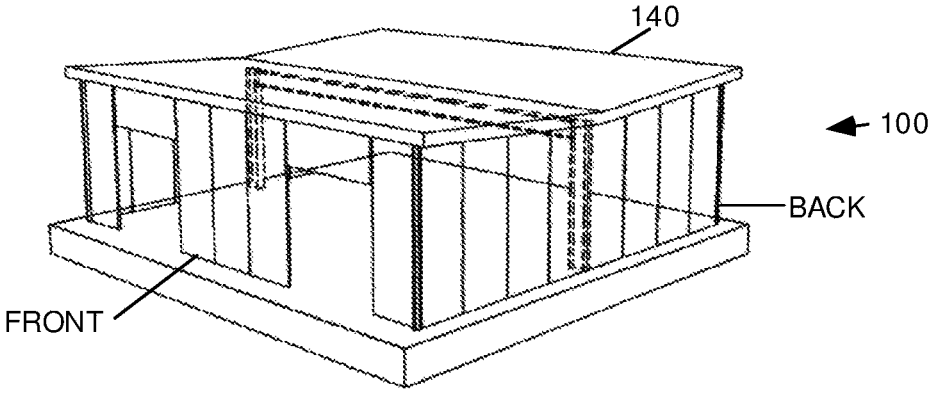
FIG. 16 is a perspective view of a building structure with a roof comprising a plurality of planes that slope upward from the center of the structure.

FIGS. 15 and 16 show alternative roof styles. In FIG. 15, roof 140 is higher at the center of building 100 than at the front and back walls. In FIG. 16, roof 140 is lower at the center of building 100 than at the front and back walls.

Additional Beam-And-Post Frame Units

Figure 17:
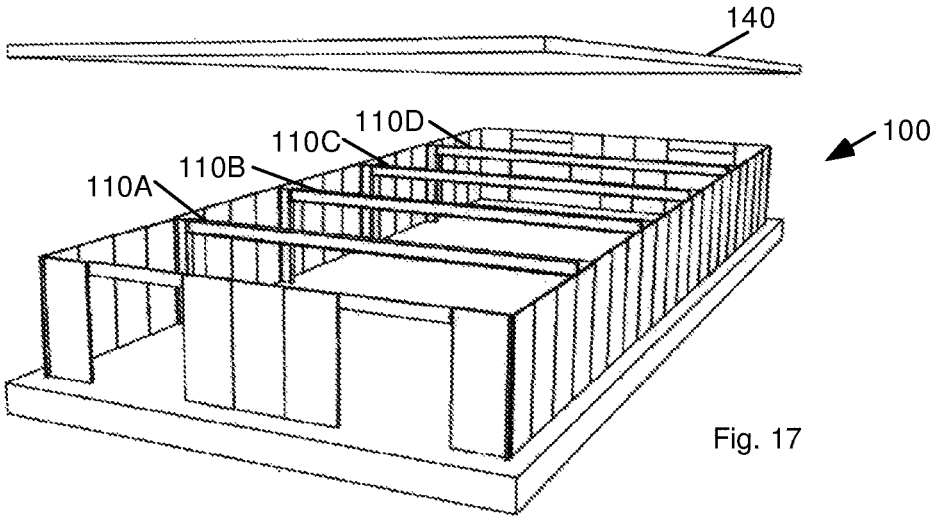
FIG. 17 shows an alternative to the structure of FIGS. 1 and 2 in which the structure includes a plurality of beam-and-post frames.

FIG. 17 shows a building 100 with roof 140 removed to reveal the interior. A plurality of beam-and-post units 110A-100D are distributed along the depth of building 100. This arrangement allows for a building 100 of virtually any depth from front to back.

CONCLUSIONS, RAMIFICATIONS, SCOPE

As can be seen from the above description and the drawings, we have devised a building that is constructed from very few elements. A single frame element that is secured to a concrete slab supports a plurality of prefabricated wall and roof panels. The frame element provides shear strength to the building and serves to support its roof load while also preventing lifting of the roof during winds.

All components of the building are easily prefabricated and then shipped to a construction site for assembly by workers with minimal building skills.

While the above description contains many specificities, these should not be construed as limitations on the scope, but as exemplifications of some present embodiments. Many other ramifications and variations are possible using the system and methods described. For example, the building described is mounted on a concrete foundation slab, yet a similar structure can be mounted on a slab made of a different material than concrete. It may not be a slab on grade structure but may be constructed above the ground, e.g., on a rooftop.

The cross section of the rigid steel I-beam shown may be rectangular or circular rather than the I- or H-shaped, and may be made of another rigid material other than steel, such as concrete, fiberglass, or wood. The wall and roof panels may be the insulating foam sandwiched between sheets of steel as described, but may also be made of other materials, such as wood, plastic or rigid cement sheets. The panels may also be made of multiple materials in many layers.

While the building as described shows a layout of the walls in a rectilinear form with walls joined at 90° corners, another layout may also display non-rectilinear corners, such that the structure may be asymmetrical. In lieu of a building with panels on all four side walls with holes cut for windows and doors, the structure may have a window or door hole so large that it comprises a major portion—or even all—of a side wall. The dimensions, shapes, and materials may all be changed so long as consistent with the inventive principles.

Thus the scope should be determined by the appended claims and their legal equivalents, rather than the examples and particulars given.

The invention claimed is:

1. A building structure having a perimeter of a predetermined size that encloses an interior space, said building structure consisting of:

a slab that extends outside said perimeter, a frame comprising first and second spaced vertical posts and a beam, each post having first and second ends, said first and bottom end of each of said posts being attached to said slab at opposite ends of said perimeter, said beam being attached to and extending between said second and top ends of said posts, such that said frame has an inverted-U shape, a plurality of wall panels extending around said perimeter of said building, said wall panels being secured side-by-side to one-another and also being secured to said slab and to said posts, a plurality of roof panels for enclosing said building structure above said wall panels, said roof panels being secured side-by-side to one-another to form a flat or planar roof that has two opposite ends at two opposite sides of said perimeter, respectively, said roof panels also being secured to said wall panels, said beam of said U-shaped frame underlying and secured to an underside of said flat or planar roof, said beam having opposing vertical sides that face in opposite horizontal directions, said opposing vertical sides of said beam each being spaced from an opposite end of said roof, whereby after joining, said slab, said frame, said wall panels, and said roof form said interior space of said building structure and said frame stabilizes said building structure.

2. The building structure of claim 1 wherein at least one of said wall panels is secured to one of said posts by means selected from the group consisting of adhesives and fasteners.

3. The building structure of claim 1 wherein at least one of said roof panels is secured to said beam by means selected from the group consisting of brackets, fasteners, and adhesives.

4. The building structure of claim 1, further including at least one opening in said wall panels for use as a window or door.

5. The building structure of claim 1 wherein said roof is sloped.

6. The building structure of claim 1 wherein said frame further includes a plurality of additional posts interposed between said first and said second posts, said plurality of posts also having first and second ends, said first ends of said plurality of posts being attached to said concrete slab and said second ends of said plurality of posts being attached to said beam so that said plurality of additional posts further strengthens said frame.

7. The building structure of claim 1 wherein said frame further includes a plurality of interior panels secured to said posts and to said beam.

8. A method for constructing a building having a perimeter, consisting of the following steps:

providing a slab, providing a plurality of vertical posts having first or bottom and second or top ends, providing a beam having opposing vertical sides that face in opposite horizontal directions, providing a plurality of wall panels, and providing a plurality of roof panels for enclosing said building structure above said wall panels, said roof panels being secured side-by-side to one-another to form a flat or planar roof that has opposite ends at said perimeter, said roof panels also being secured to said wall panels, securing said first or bottom ends of said posts to said slab at opposite ends of said perimeter, securing said beam to said second or top ends of said posts, said beam extending between said second ends of said posts, said beam and said posts forming an inverted-U-shaped support frame for supporting said wall panels and at least some of said wall panels, securing said wall panels to said slab along said perimeter so that said wall panels extend around said perimeter, and securing said roof panels to said wall panels, securing said beam to said flat or planar roof, said beam of said U-shaped frame underlying and attached to said roof, said vertical sides of said beam spaced from said respective opposite ends of said roof, whereby after joining, said slab, said frame, said wall panels, and said roof form said interior space of said building structure and said frame stabilizes said building.

9. The method of claim 8 wherein said wall panels are secured to said slab by means selected from the group consisting of angle brackets, fasteners, and adhesive sealant.

10. The method of claim 8 wherein said wall panels include edges with complementary, interdigitated shapes that are secured to one-another by adhesive sealant.

11. The method of claim 8 wherein at least two of said wall panels are mitered and joined at a right angle and secured together by means selected from the group consisting of angle brackets, fasteners, and adhesive sealant.

12. The method of claim 8 wherein said roof panels are secured to said wall panels by means selected from the group consisting of angle brackets, fasteners, and adhesive sealant.

13. The method of claim 8 wherein at least one of said roof panels is secured to said beam by means selected from the group consisting of brackets, fasteners, and adhesive sealant.

14. The method of claim 8 wherein said building further includes a plurality of openings for use as at least one window and one doorway.

15. The method of claim 14 wherein said plurality of openings include at least one window frame and one door frame.

16. The method of claim 8 wherein at least one of said wall panels is secured to at least one of said posts.

17. The method of claim 8 wherein said support frame further includes a plurality of additional supports selected from the group consisting of panels and additional posts.

18. The method of claim 8 wherein said roof is sloped.

* * * * *